US010153101B2

(12) United States Patent
Kaltenborn et al.

(10) Patent No.: US 10,153,101 B2
(45) Date of Patent: Dec. 11, 2018

(54) SWITCHING SYSTEM WITH PRESELECTOR

(71) Applicant: MASCHINENFABRIK REINHAUSEN GMBH, Regensburg (DE)

(72) Inventors: Uwe Kaltenborn, Regensburg (DE); Thomas Strof, Gumboldskirchen (AT); Christian Hurm, Regensburg (DE); Anatoli Saveliev, Zeitlarn (DE); Gerhard Baeuml, Regenstauf (DE); Alfred Bieringer, Geiselhoering (DE); Eduard Zerr, Regensburg (DE); Wolfgang Albrecht, Wenzenbach (DE); Martin Hausmann, Lappersdorf (DE); Andreas Stocker, Neutraubling (DE)

(73) Assignee: MASCHINENFABRIK REINHAUSEN GMBH, Regensburg (DE)

( * ) Notice: Subject to any disclaimer, the term of this patent is extended or adjusted under 35 U.S.C. 154(b) by 158 days.

(21) Appl. No.: 14/915,491

(22) PCT Filed: Sep. 26, 2014

(86) PCT No.: PCT/EP2014/070585
§ 371 (c)(1),
(2) Date: Feb. 29, 2016

(87) PCT Pub. No.: WO2015/044324
PCT Pub. Date: Apr. 2, 2015

(65) Prior Publication Data

US 2016/0211090 A1 Jul. 21, 2016

(30) Foreign Application Priority Data

Sep. 26, 2013 (DE) ..... 10 2013 110 652

(51) Int. Cl.
*H01H 9/00* (2006.01)
*H01F 29/04* (2006.01)
(Continued)

(52) U.S. Cl.
CPC ..... *H01H 9/0038* (2013.01); *H01F 27/28* (2013.01); *H01F 27/40* (2013.01); *H01F 29/04* (2013.01); *H01H 9/0005* (2013.01)

(58) Field of Classification Search
CPC ..... H01H 9/0038
See application file for complete search history.

(56) References Cited

U.S. PATENT DOCUMENTS 4,621,298 A 11/1986 McMillen
6,960,844 B1 11/2005 Al-Hosini
(Continued)

FOREIGN PATENT DOCUMENTS

DE 1763020 A 8/1971
DE 2647302 A 4/1978
(Continued)

*Primary Examiner* — Daniel Cavallari
(74) *Attorney, Agent, or Firm* — Andrew Wilford

(57) ABSTRACT

The invention relates to a switching arrangement (15) with a pre-selector (28) for a power transformer (10, 40) which has multiple windings (12, 14). The pre-selector is designed to optionally connect at least one first winding (12) to one of the two end contacts (30, 32) of at least one second winding (14). At least one first switch is arranged in the connection between the pre-selector (28) and the first winding (12), thereby allowing the pre-selector to be switched in an arc-free manner and thus in a gas-free manner as well.

13 Claims, 8 Drawing Sheets

(51) Int. Cl.
*H01F 27/28* (2006.01)
*H01F 27/40* (2006.01)

(56) References Cited

U.S. PATENT DOCUMENTS

| | | | | |
|---|---|---|---|---|
| 8,576,038 | B2 | 11/2013 | Kraemer | |
| 2011/0057662 | A1* | 3/2011 | Eriksson | H02H 1/0015<br>324/536 |
| 2015/0061806 | A1* | 3/2015 | Teising | H01H 9/0027<br>336/150 |

FOREIGN PATENT DOCUMENTS

| | | | |
|---|---|---|---|
| DE | 2936534 | A | 3/1981 |
| DE | 3224860 | A | 3/1983 |
| DE | 102012202667 | A | 8/2013 |
| GB | 1556485 | A | 11/1979 |
| GB | 2424766 | A | 10/2006 |
| WO | 2012019514 | A | 2/2012 |

* cited by examiner

SWITCHING SYSTEM WITH PRESELECTOR

CROSS REFERENCE TO RELATED APPLICATIONS

This application is the US-national stage of PCT application PCT/EP2014/070585 filed 26 Sep. 2014 and claiming the priority of German patent application 102013110652.8 itself filed 26 Sep. 2013.

FIELD OF THE INVENTION

The present invention relates to a switching arrangement with a preselector and optionally a polarity circuit for selectable connection of a plurality of windings of a power transformer, i.e. a transformer with a power of at least 100 kilowatts, preferably with a power of more than 1 megawatt.

BACKGROUND OF THE INVENTION

Such a transformer can comprise a plurality of windings arranged in a regulating transformer, for example as at least one primary winding and at least one regulating winding with a plurality of winding taps. In the switching arrangement according to the invention the preselector is provided for the purpose of connecting a first winding of the transformer selectably with one of the two ends of a second winding for subtractive or additive coupling of the windings. In addition, the switching arrangement according to the invention has a polarity circuit that connects a defined point of the second winding, for example a center tap or one of the two end taps, with the first winding or a load diverter by a polarity resistance. The idea of the polarity circuit is to bring the second winding to a defined potential. A circuit of that kind is also known from DE 32 24 860. The polarity circuit with the polarity resistance has the consequence of a significantly smaller arc formation during switching over of the preselector, which in the case of tap changers in an oil bath environment leads to a significantly smaller induction of gas into the oil bath. However, a loss current constantly flows by the polarity resistance, which has the consequence that the polarity resistance heats and can lead to heating of the surrounding oil medium and in addition the effectiveness of the transformer is reduced.

OBJECT OF THE INVENTION

It is therefore an object of the invention to create a tap changer that allows arc-free switching-over of the preselector with lower losses than in the case of the prior art.

SUMMARY OF THE INVENTION

According to the invention this object is attained by a switching arrangement with a preselector for a power transformer having a plurality of windings is proposed, wherein the preselector is constructed for the purpose of connecting at least one first winding selectably with one of the two end contacts of at least one second winding, usually a regulating winding.

According to the invention, at least one first switch is arranged in the connection between the preselector and the first winding. By means of this first switch the preselector can be decoupled from the first winding during the switching over so that gas-free switching over of the preselector is possible. For that purpose, the first switch is preferably actuated before switching-over of the switching element of the preselector.

Use is preferably made for the first switch of switches that themselves switch in gas-free manner, such as, for example, semiconductor switches, varistors, vacuum switches and thermistors. These switches can also be combined with one another and/or with mechanical load switches, preferably in a parallel circuit. Thus, for example, the first switch can be formed by a parallel connection of a first mechanical load switch with a vacuum switch or by a parallel connection of a varistor with a vacuum switch.

For preference the first switch is or includes a vacuum switch. Vacuum switches have proved themselves in the power field as switching elements that switch free of gas and reliably. They can also be arranged in an oil bath together with a power transformer. These vacuum switches are as a rule constructed as vacuum interrupters.

The first switch can preferably be formed by a diode circuit or include a diode circuit. This is particularly advantageous for circuits in which switching takes place at the zero transition of the alternating voltage.

In an advantageous embodiment of the invention the part, which is connected with the first winding, of the first switch is grounded by a varistor and/or a capacitor and/or an RLC network and/or combinations of RLC networks and varistors. In this way it is possible to dissipate high-frequency return voltages that arise when the switching arrangement is in a load-free state during the switching-over of the preselector.

In a preferred embodiment of the invention a polarity circuit connects a defined point of the second winding with the first winding during switching over of the preselector. The defined point can preferably be the center tap of the second winding or selectably one of the two end taps of the second winding. However, in principle it is possible to make use of any point of the second winding. In addition, according to the invention at least one second switch is connected or connectable into the connection of the polarity circuit with the first winding. In this way, the advantages described above in connection with the switching-over of the preselector are realized by the arrangement of the first switch even the polarity circuit is switched by means of the second switch. Thus, the polarity circuit is also switched in gas-free manner by means of the second switch. As second switch, use can be made of any of the switch types described above in connection with the first switch.

For preference the first switch also forms the second switch and is thus selectably connectable into the connection of the preselector with the first winding and into the connection of the polarity circuit with the first winding. This has the advantage that only one switch has to be used for the first and second switches. However, a separate switch, for example a vacuum switch, can also be arranged for each of these connections (preselector, polarity circuit).

The connection of the defined point of the second winding with the first winding of the transformer by means of the polarity circuit has the consequence that on switching over of the preselector the defined point lies at the same potential as the first winding. The polarity circuit is switched on and off for the switching-over of the preselector by the second switch. The switching process takes place in arc-free manner by virtue of the second switch. In addition, the switching-over, i.e. the separating and connecting of the preselector, in that regard takes place initially by a vacuum switch and only after actuation of the vacuum switch is the switching element of the preselector, for example a reverser, actuated.

Thus, a potential-free and thereby completely arc-free switching over of the preselector can be realized by means of the invention. Not only the polarity circuit, but also the preselector can in that case have an individual vacuum switch or, by an appropriate circuit, they can use a vacuum switch in common, which is possible because the switching processes of the polarity circuit and the preselector can take place separately in time.

If not only the preselector, but also the polarity circuit have an individual switch, for example vacuum switch, these can, for example, be coupled together in a mechanical or electrical manner, which increases operational reliability.

The polarity circuit is preferably a polarity resistance or other electronic component with a defined resistance characteristic curve.

The second switch is so connected into the connection of the polarity circuit with the first winding that the polarity circuit is connected with the first winding before the switching-over of the preselector. As a result, the second winding is brought to a defined potential. The first switch in the connection of the preselector and the first winding is subsequently opened. The switching element of the preselector is now free of potential and can be switched over to the new position. After the switching-over of the preselector the first switch is closed again. By virtue of the polarity circuit the voltages/currents to be switched by the first switch of the preselector are in that case kept within limits. Finally, the second switch for connection of the polarity circuit with the first winding is opened again, as a result of which the polarity circuit is switched off again. The switching-over process of the preselector is thus concluded. The invention thus allows an almost completely gas-free actuation of the polarity circuit and also of the preselector of a switching arrangement, for example of a tap changer.

In an advantageous development of the invention the first and second switches are formed by the same switch that can be selectably connected into the connection of the preselector or the polarity circuit with the first winding. This switch is described in the following as vacuum switch, but can also be formed by another switching element according to the above explanations. For preference, the vacuum switch is connected with the first winding and a switching bridge is connected with the vacuum switch, by which bridge the vacuum switch is connectable not only with the preselector, but also with the polarity circuit. This preferred embodiment of the invention has the advantage that merely one vacuum switch, for example a vacuum interrupter, has to be provided to switch both the preselector and the polarity circuit by means of the vacuum switch. If required, the vacuum switch is then connected into the connection of the preselector with the first winding or into the connection of the polarity switch with the first winding.

In an advantageous development of the invention this switching bridge has four bridge switches, of which a first bridge switch and a second bridge switch connect the first terminal, which is connected with the first winding, of the vacuum switch with the preselector and with the polarity circuit and of which a third bridge switch and fourth bridge switch connect the second terminal of the vacuum switch with the polarity circuit and with the preselector. A bridge circuit of that kind makes it possible to connect the vacuum switch in simple manner into the connection of the polarity circuit with the first winding and into the connection of the preselector with the first winding.

In an advantageous development of the above-mentioned embodiment the first bridge switch and also the third bridge switch are coupled and also the second bridge switch and fourth bridge switch are coupled. This cross-actuation of the bridge switches of the switching bridge represents a simple way of connecting the vacuum switch into the connection of the preselector with the first winding on the one hand and into the connection of the polarity circuit with the first winding on the other hand.

The particular advantage of this embodiment of the invention resides in the fact that a single switch, for example vacuum switch, can be used for the purpose of gas-free switching of not only the preselector, but also the polarity circuit, which is a decisive step in the direction of a tap changer with gas-free operation. The freedom of actuation of a tap changer from gas is important because tap changers of that kind are usually arranged in a common oil bath together with the regulating transformer or in a separate oil bath. An arc and corresponding induction of gas during switching leads to contamination of the oil bath and thus to reduction in its insulating capability and cooling capability. As a result there is a greater need for maintenance, particularly with respect to oil exchange in the regulating transformer, which due to more focused environmental conditions constitutes an outlay and a cost factor that should not be under-estimated.

In another embodiment of the invention at least one respective separate switch, for example vacuum switch, is arranged not only in the connection of the preselector with the first winding, but also in the connection of the polarity circuit with the first winding. This embodiment does indeed need two switches, for example vacuum interrupters, but this embodiment can be realized with a lower outlay in terms of switching technology. For preference, in this embodiment the first and second switches are mechanically or electrically coupled, which enables simple control of actuation of the polarity circuit in conjunction with the switching-over of the preselector. The time sequence is, in particular, such that prior to the switching-over of the preselector firstly the polarity circuit has to connect the defined tap of the second winding with the first winding, subsequently the preselector is switched over and finally the connection of the polarity circuit is separated again. This switching sequence can be realized in simple manner by coupling of the two vacuum switches.

The vacuum switch is preferably a vacuum interrupter, which has proved in operation in conjunction with tap changers to be a switch that switches reliably and in gas-free manner.

The defined point, which is to be connected with the polarity circuit, of the second winding is preferably connected with either the center tap or selectably one of the two end taps of the second winding, in which case use can be made here of a switch that selectably connects the polarity circuit with one of the two end taps of the second winding, such as realized in, for example, DE 10 2009 060 132 [U.S. Pat. No. 8,576,038]. In principle, however, the polarity circuit can be connected with any point of the second winding.

The first and second windings can be any desired windings, for example, several primary windings of a transformer. They can also be formed at least one primary winding and at least one tap winding of a regulating transformer. In the last-mentioned case, the switching arrangement is preferably a tap changer.

BRIEF DESCRIPTION OF THE DRAWING

The invention is described in the following by example on the basis of the schematic drawing, in which.

SPECIFIC DESCRIPTION OF THE INVENTION

Figure 1C:
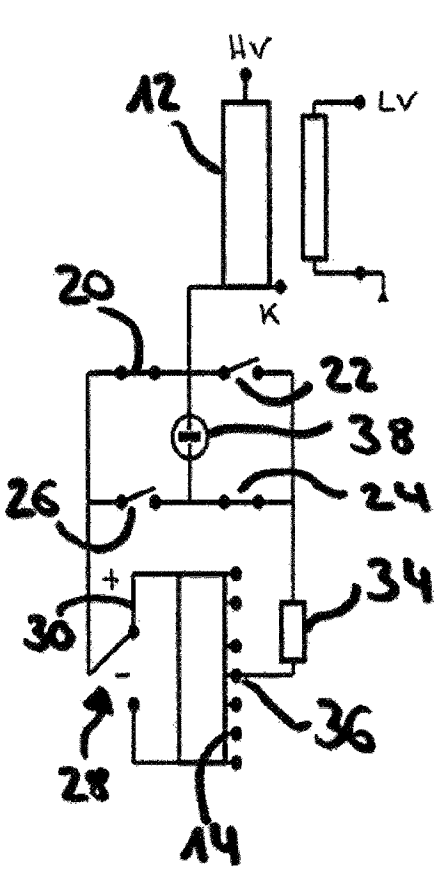
FIGS. 1*a-m* show a circuit diagram of a tap changer according to the invention with a vacuum switch and a bridging switch for alternating connection of the vacuum switch with the preselector and also with the polarity circuit in a sequence of thirteen switching steps.
Figure 1B:
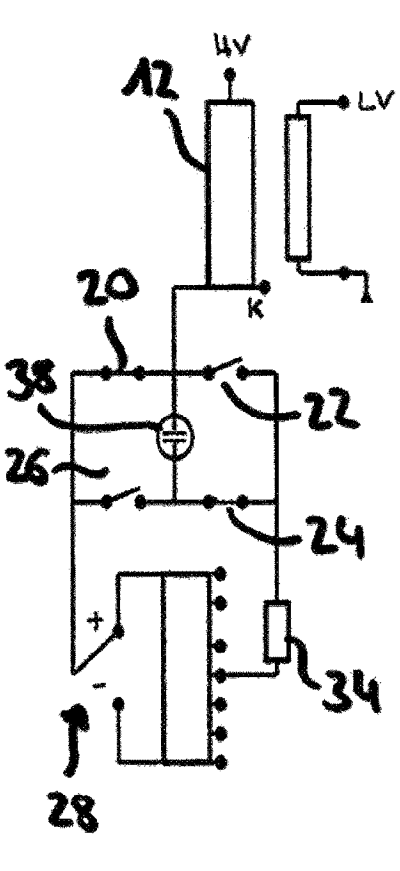
Figure 1A:
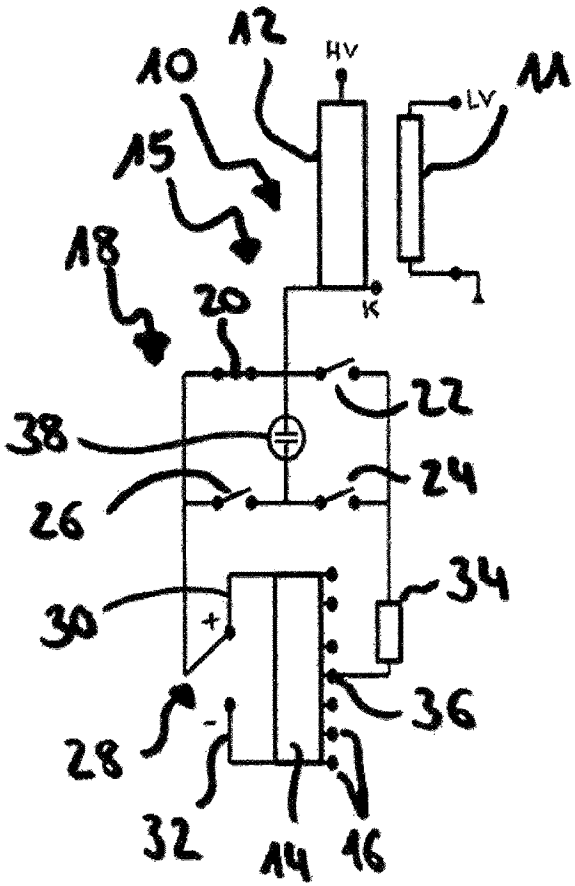
Figure 1F:
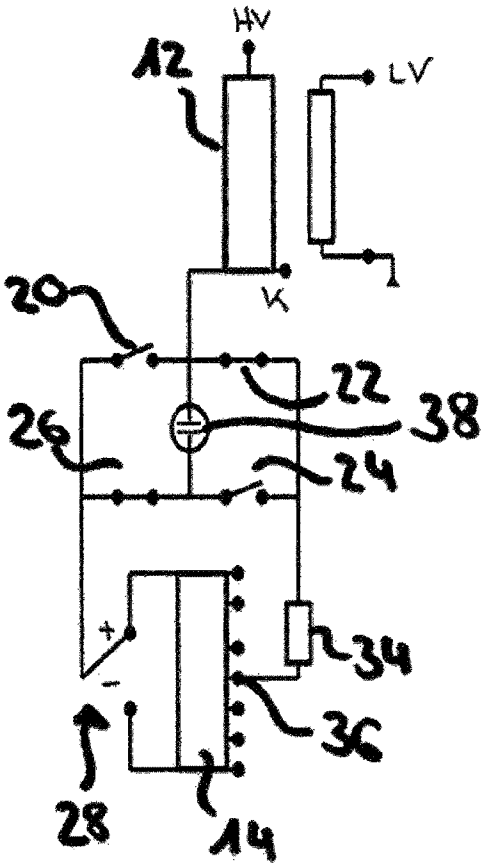

FIG. 1*a* shows a regulating transformer 10 such as used, for example, as a power transformer in the field of power supply. The transformer 10 has a low-voltage winding 11 and also two high-voltage windings in the form of a primary winding 12 as first winding and a regulating winding 14 as second winding that has a plurality of taps 16. The regulating transformer 10 additionally includes, as switching arrangement, a tap changer 15 that comprises a preselector 28, a fine selector 17 and a load changeover switch (not illustrated here). In a further embodiment of the invention the tap changer can be constructed as a so-called load selector. The primary winding 12 is connected with a bridge circuit 18 of four bridge switches 20, 22, 24, 26 and a vacuum switch 38, for example a vacuum interrupter. The vacuum switch 38 forms not only a first switch for connecting the preselector 28 with the primary winding 12, but also a second switch for connecting a polarity circuit 34 with the primary winding 12. One branch of the bridge circuit is connected with the preselector 28 that in turn is connectable with the two ends 30, 32 of the regulating winding 14. The polarity circuit is connected with the other branch of the bridge circuit and is formed by a polarity resistance 34 that is in turn connected with a center tap 36 of the tap winding 14. The vacuum switch 38 is connected in the center of the bridge circuit 18. It is possible by the bridge circuit 18 to connect the vacuum switch 38 selectably into the connection of the preselector 38 with the primary winding 12 or into the connection of the polarity resistance 34 with the primary winding 12.

In particular, the bridge circuit 18 serves the purpose of connecting the regulating winding 14 with the primary winding 12, during the switching-over process of the preselector 28, by the polarity resistance 34 so as to thus keep the regulating winding 14 at a defined potential and thereby reduce the high potential differences and capacitive currents when switching over of the preselector 28 takes place. Actuation of the individual bridge switches 20 to 26 of the bridge circuit 18 during the switching-over of the preselector is described in the following in the figures FIG. 1*a* to FIG. 1*m*.

FIG. 1*a* shows the normal operating state of the transformer 10 prior to actuation of the preselector 28, in which the primary winding 12 is connected by the first bridge switch 20 of the bridge circuit 18 and the preselector 28 with the first end 30 of the tap winding. The load tapping takes place during operation by the fine selector 17 and the load changeover switch. Before actuation of the preselector, there is movement by the fine selector to the point K at the primary winding 12 and the primary winding is connected with the load tapping point 19. The fine selector is illustrated only schematically. Obviously, the fine selector contacts one of the taps 16 of the regulating winding 14. It is now intended to switch over the preselector 28 from the first end 30 to the second end 32 of the tap winding 14.

For this purpose, as illustrated in FIG. 1*b*, initially the third bridge switch 24 is closed so that the polarity resistance 34 is now connectable with the primary winding 12 by the still-open vacuum switch 38.

In FIG. 1C the vacuum switch 38 is now closed so that on the one hand, as before, the first end 30 of the tap winding 14 is connected by the first bridge switch 20 with the primary winding 12, but on the other hand the polarity resistance 34 is also connected by the third bridge switch 24 and the vacuum switch 38 with the primary winding 12.

Figure 1E:
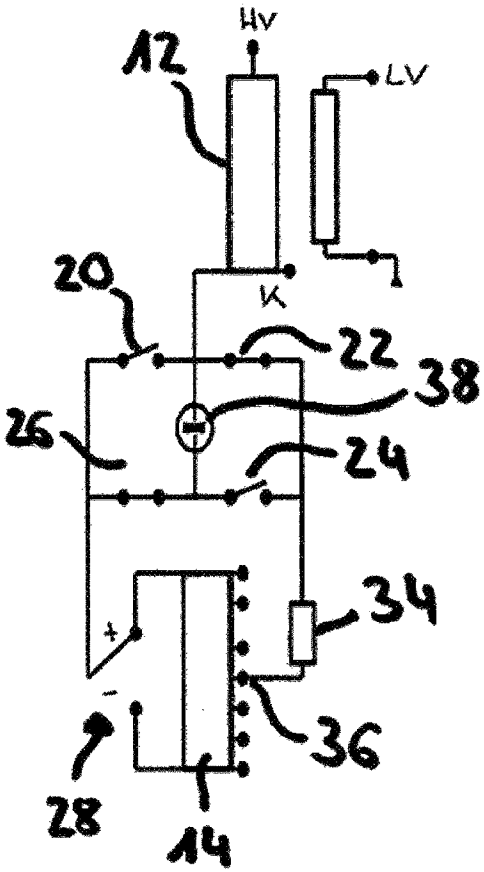
Figure 1D:
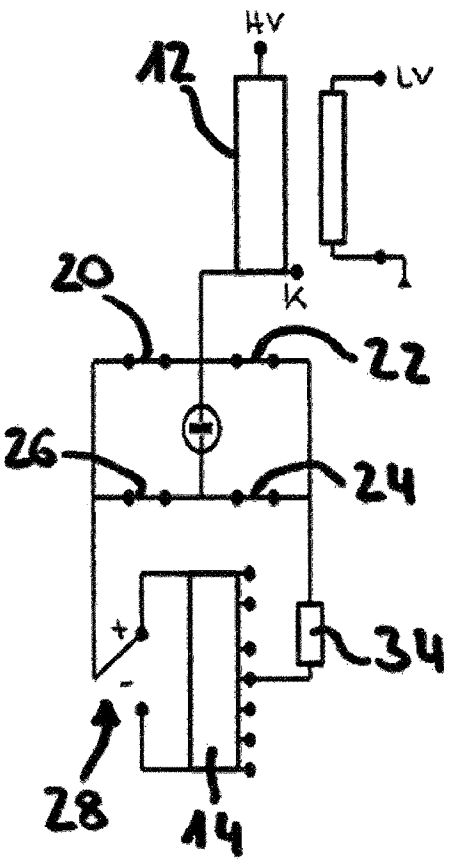

In the next step according to FIG. 1*d*, now the second bridge switch 22 and also the fourth bridge switch 26 are also closed so that now the preselector 28 and also the polarity resistance 34 are connected by the vacuum switch and correspondingly by the first and second bridge switches 20, 22 with the primary winding 12.

In the next step according to FIG. 1*e*, the first bridge switch 20 and the third bridge switch 24 are opened, whereby the preselector 28 continues to be connected only by the closed vacuum switch 38 with the primary winding 12, which winding is, however, directly connected by the second bridge switch 22 with the polarity resistance 34 connected with the center tap 36 of the regulating winding 14.

In the next step according to FIG. if the vacuum switch 38 is opened, whereby the primary winding 12 is connected only with the center tap 36 of the regulating winding 14 by the second bridge switch 22 and the polarity resistance 34. The preselector 28 is now no longer connected with the primary winding 12, so that in the next step according to FIG. 1*g* this can be opened without an arc then occurring.

Figure 1I:
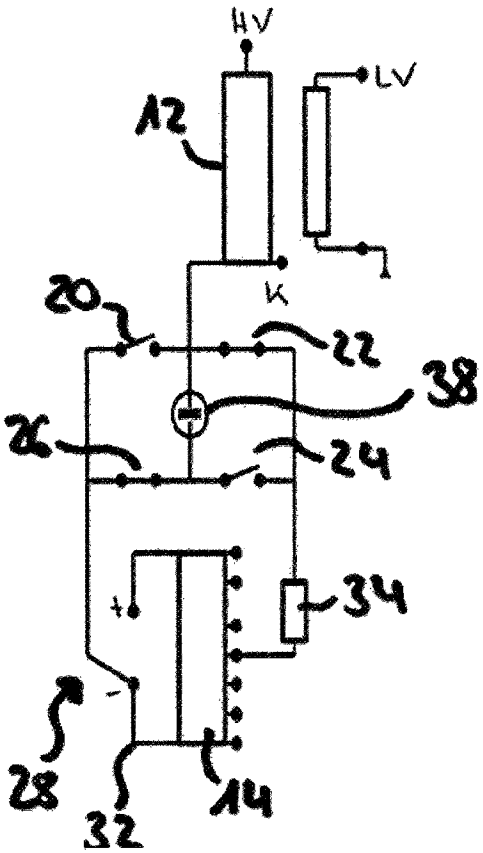
Figure 1H:
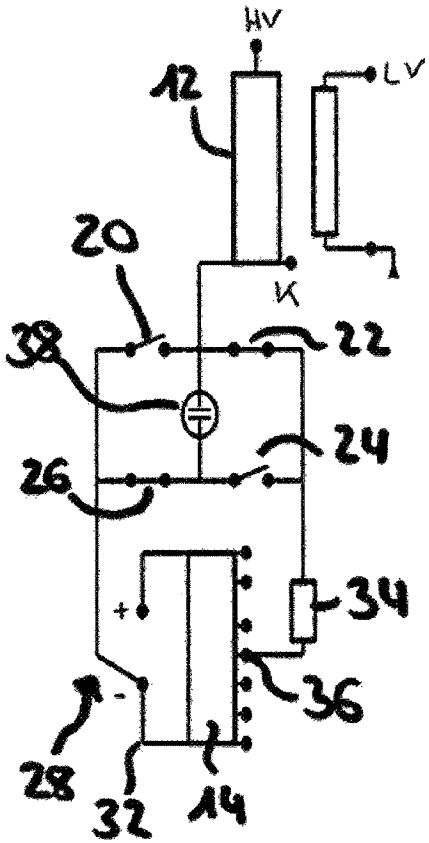
Figure 1G:
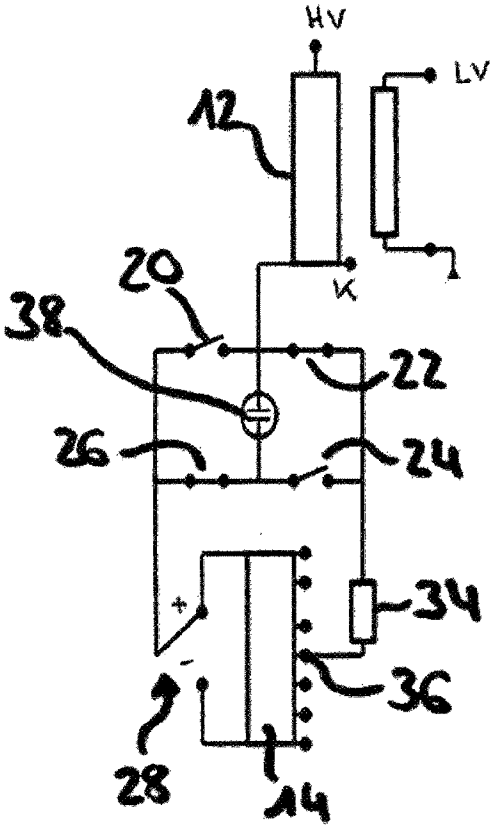

The preselector 28 can now, as illustrated in FIG. 1*h*, be switched through from the neutral position illustrated in FIG. 1*g* to the switching position that is illustrated in FIGS. 1*h* and 1*n* which the preselector 28 is connected with the second end 32 of the regulating winding 14. Since the vacuum switch 38 is opened again, this does not lead to an arc, so that this switching-over process takes place in gas-free manner. As before, during this process the regulating winding 14 is connected by its center tap 36 and the polarity resistance 34 with the primary winding 12, which prevents occurrence of high voltages.

As shown in FIG. 1*i*, the vacuum switch 38 is now closed, which has the consequence that now the second end 32 of the regulating winding 14 is connected by the preselector 28, the closed fourth bridge circuit 26 and also the closed vacuum switch 38 with the primary winding 12. Since this connection is realized through the vacuum switch 38, this switching process also takes place without production of an arc and thus in gas-free manner.

Figure 1L:
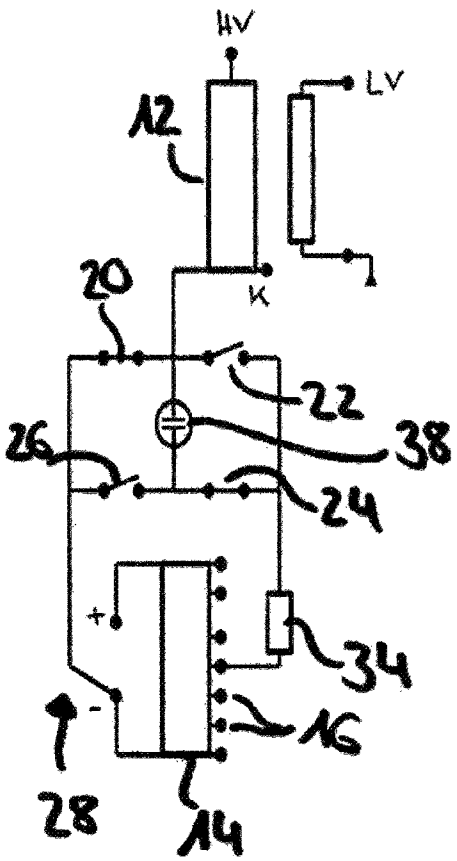
Figure 1K:
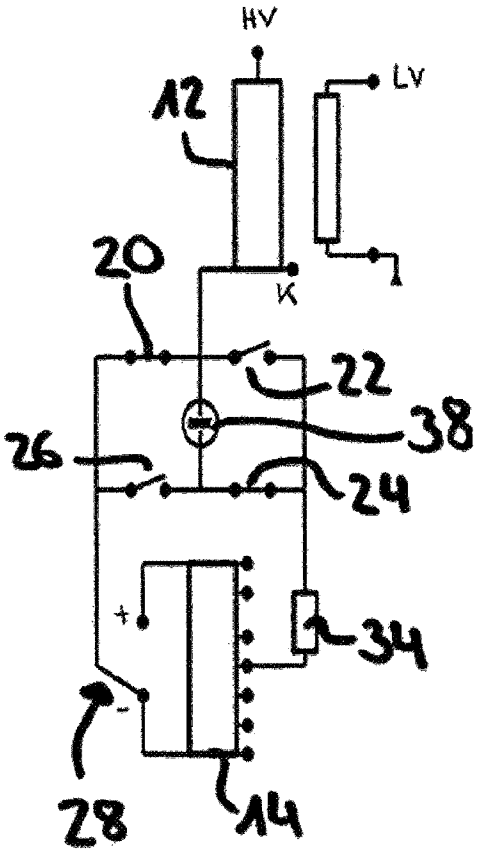
Figure 1J:
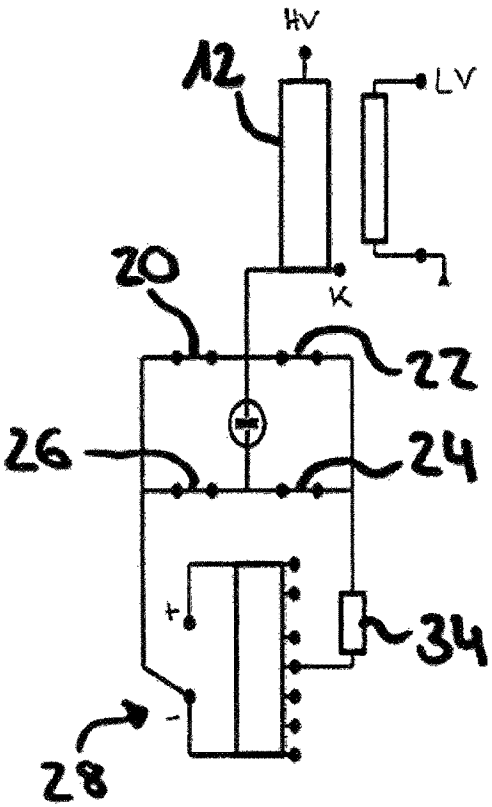

After the connection of the preselector 28 by the vacuum switch 38, the first bridge switch 20 can now, as in FIG. 1*j*, be closed again so that the preselector 28 is directly connected with the primary winding 12 by the first bridge switch 20. Here it must be added that by virtue of the coupling of the regulating winding 14 to the primary winding 12 via the polarity resistance 34 the difference in potential or the switching current at the vacuum switch 38 is significantly reduced so that the vacuum switch is, by comparison, subject to less loading during the switching process.

Figure 1M:
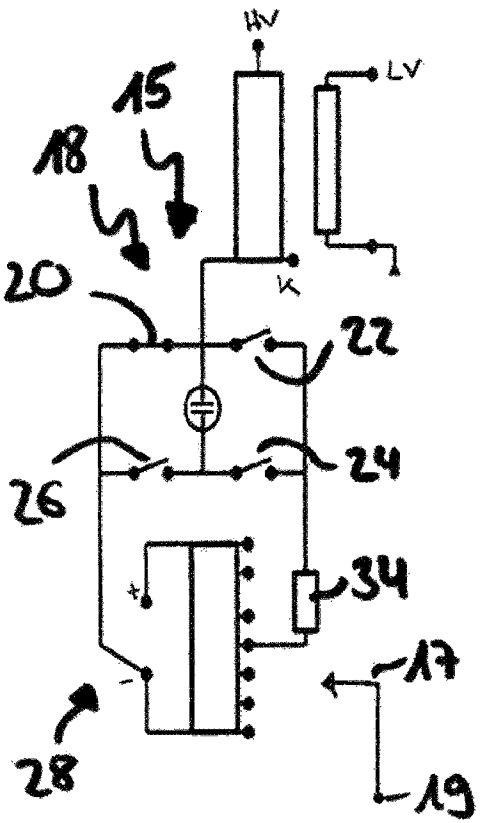

In the next step according to FIG. 1*k*, the second bridge switch 22 is now opened again so that the polarity resistance 34 remains connected with the primary winding 12 only by the closed vacuum switch 38. The vacuum switch 38 is now opened, as illustrated in FIG. 1*l*. The polarity resistance 34 is thereby separated from the primary winding 12. The regulating winding 14 is thus still connected with the primary winding 12 only by its second end 32 via the preselector 28 and the first bridge circuit 20, as thus represented by the intended switching-over position of the preselector. Finally, as is shown in FIG. 1*m*, the third bridge switch 24 is opened so that the starting position according to FIG. 1*a* is again reached, but with the difference that the primary winding 12 is now connected by the preselector 28 with the second end 32 of the regulating winding 14 instead of with the first end 30 of the regulating winding 14 prior to the switching-over process.

This switching sequence makes it clear that arc-free switching of not only the preselector 28, but also of the polarity circuit during the switching-over process of the preselector 28 can be performed with only a single vacuum switch 38.

Figure 2:
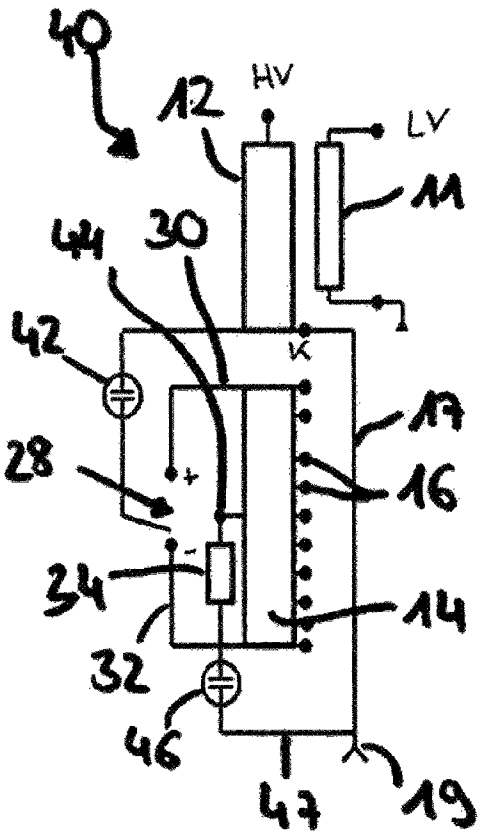
FIG. 2 shows a further embodiment of the invention, in which not only the preselector, but also the polarity circuit have a vacuum switch in the connection with the primary winding.

FIG. 2 shows a further embodiment of the invention. Parts identical with or functionally the same as FIG. 1 are in that case provided with the same reference numerals. In the circuit according to FIG. 2 the transformer 40 similarly has, as first and second windings, a primary winding 12 and a regulating winding 14. The primary winding 12 is connectable with the first end 30 or the second end 32 of the regulating winding 14 by a series circuit of a first switch 42, for example a vacuum interrupter, and the preselector 28. The polarity circuit is formed by a polarity resistance 34 that is connected with the tap winding 14 by a separate center tap 44. The polarity resistance is connectable with the primary winding 12 by a second switch 46. The second switch 46 can be constructed as a vacuum interrupter. In this circuit separate switches 42, 46, which then have to be correspondingly actuated, are provided not only for connection of the preselector 28 with the primary winding 12, but also for the connection of the polarity resistance 34 with the primary winding 12, so that both the preselector 28 and the polarity circuit can be switched in gas-free manner. With respect to actuation of the preselector 28 this means that prior to separation of the preselector 28 the first switch 42 is opened and the first switch 42 is closed again only after the switching-over of the preselector 28.

With respect to actuation of the second switch 46 this means that the second switch 46 is closed before the first switch 42 is opened. The second switch 46 is opened again only when the preselector 28 has switched over and the first switch 42 is closed again. After closing of the second switch 46, the regulating winding is connected by the polarity resistance 34 and the polarity circuit 47 with the load tapping point 19.

Figure 3:
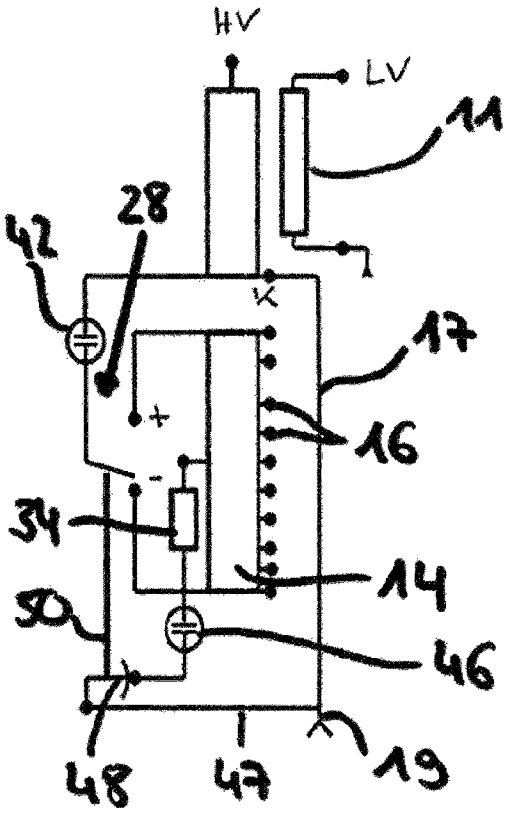
FIG. 3 shows an arrangement according to FIG. 2 in which, in addition, a mechanical switch coupled with the preselector is provided.

FIG. 3 shows a embodiment of the invention that is almost identical with FIG. 2, wherein again parts that are identical and functionally the same are provided with the same reference numerals. By contrast to the embodiment of FIG. 2, an additional auxiliary switch 48 is provided in FIG. 3, which is mechanically or electrically coupled with the preselector 28 by a coupling 50.

It is alternatively also possible to couple the actuation of the first and second vacuum switches 42, 46 by an electrical or mechanical coupling, in which case the coupling is to make possible actuation of the vacuum switches 42, 46 with an offset in time.

Figure 4:
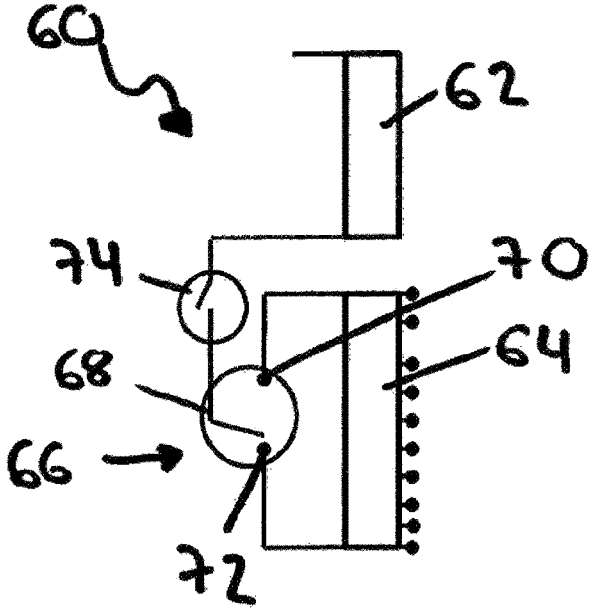
FIG. 4 shows a circuit arrangement with a preselector and a first switch between preselector and a first winding of a power transformer.

FIG. 4 shows a regulating transformer 60 such as used, for example, as a power transformer in the field of power supply. The transformer 60 has two high-voltage windings in the form of a primary winding 62 as first winding and a regulating winding 64 as second winding that has several taps as in FIG. 1. The regulating transformer 60 additionally includes a preselector 66 that is constructed as a reverser and the tap 68 of which is connected with the primary winding 62, the preselector being able to switch between two switch contacts 70, 72 that are each connected with a respective one of the two end contacts of the regulating winding 64. A first switch 74 is arranged in the connection between the primary winding 14 and the reverser 66. The advantage of this embodiment according to the invention is that during switching-over of the reverser 66 the first switch 74 can be opened so that the preselector 66 can be switched free of voltage and thus free of gas, i.e. without producing an arc in the oil. The first switch 74 is closed again only after the switching-over of the reverser 66. The first switch 74 is preferably a switch that switches in gas-free manner, as illustrated in, for example, one of FIGS. 5*a* to 5*e*.

The switching configurations shown in FIGS. 5*a* to 5*d* can be used as a first switch 74 in the switching arrangement of FIG. 4.

Figure 5A:
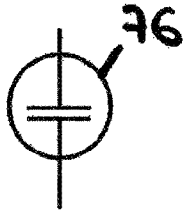
FIGS. 5*a-d* show different forms of embodiment for the first switch of FIG. 4.

FIG. 5*a* shows, as first switch, a vacuum switch 76, for example a vacuum interrupter known per se. The advantage of this switch resides in the encapsulated and thus gas-free switching so that the switching processes of the first switch 74 take place in connection with the switching-over process of the preselector in similarly gas-free manner.

Figure 5B:
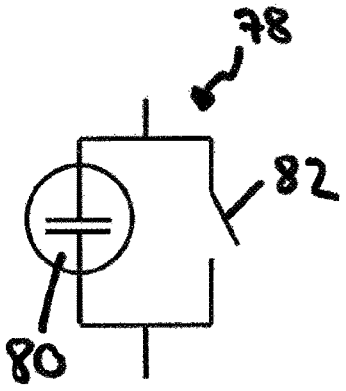

FIG. 5*b* shows, as first switch 74, a switching arrangement 78 in the form of a parallel connection of a vacuum switch 80 with a mechanical load switch 82. The vacuum switch 80 can in that case be used for the pure switching-over process, whilst the mechanical load switch 82 takes over the permanent contact-making so as to preserve the vacuum switch. This switching arrangement 78 has a long service life.

Figure 5C:
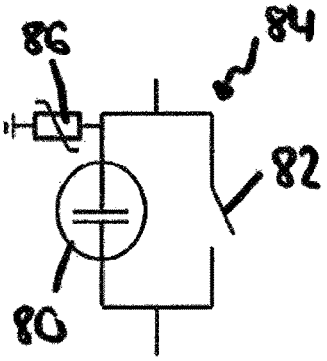

FIG. 5*c* shows a switching arrangement 84 according to FIG. 5*b*, in which parts that are identical or functionally the same are provided with the identical reference numerals. In addition to the switching arrangement 78 in FIG. 5*b*, this switching arrangement 84 additionally has a varistor 86 by which the part of the switching arrangement connected with the primary winding 12 is grounded. This varistor conducts excess voltages away from the switching arrangement during the switching process that, for example, protects the vacuum switch 80, the mechanical load switch 82 as well as the primary winding 12 and regulating winding 14. If instead of the varistor or additionally to the varistor (in parallel connection) a capacitor or resistor is also provided, high-frequency induction voltages during the switching-over process of the preselector are also effectively dissipated.

Figure 5D:
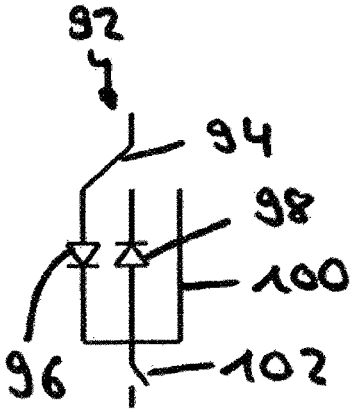

Finally, FIG. 5*d* shows a switching arrangement 92 consisting of a series circuit of a first selector switch 94, a parallel circuit of two diodes 96, 98 connected in opposite sense, a conductor 100 and an auxiliary switch 102. The selector switch can be selectably switched to one of the two diodes 96, 98 or to the conductor. The start instant for switching of the diodes 96, 98 can be set by the auxiliary switch 102. It is thus possible to switch during the zero transition of the alternating voltage and therefore in gas-free manner.

Figure 6:
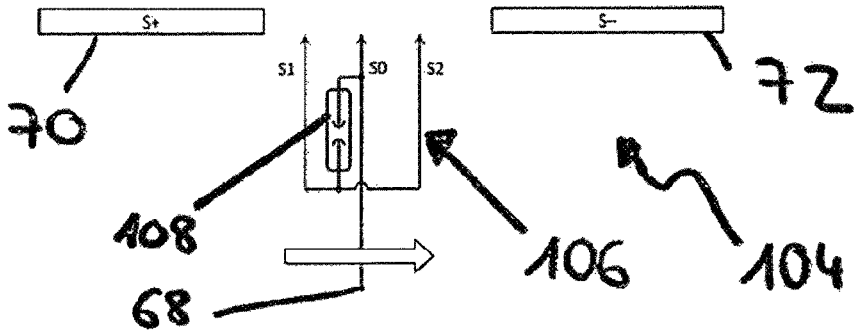
FIG. 6 shows a schematic illustration of a preselector in the form of a rotary switch with integrated vacuum switch in the switch elements.

FIG. 6 shows a preselector 104 that can, for example, be arranged coaxially with respect to a fine selector or load selector. Reference is made to FIG. 4 (reverser 66) with regard to the switching configuration of the preselector 104. The two switch contacts 70, 72 connected with the ends of the regulating winding are in that case arranged to be stationary. The preselector 104 includes a switch group 106, which is movable in or counter to the arrow direction, with three switch elements S1, S0 and S2 that co-operate with the stationary switch contacts 70, 72. The two outer switch elements S1 and S2 are connected by a vacuum switch 108 with the center switch contact S0 that is in turn connected with the tap 68 of the preselector 104. This is connected with the primary winding 12 directly or by a first switch 74.

The outer switch elements S1 and S2 are so movable by the co-operation with the stationary switch contacts 70, 72 that they can actuate the vacuum switch 108. It is thereby ensured that the separation of the switching configuration from a stationary switch contact 70, 72 always takes place by the vacuum switch 108 and thus in gas-free manner.

Figure 7A:
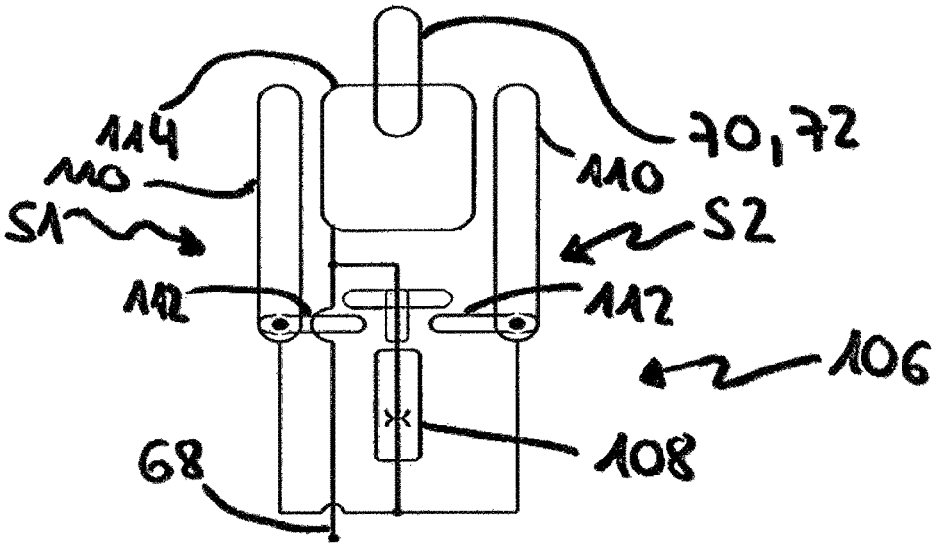
FIGS. 7*a-d* show the switching sequence of the preselector of FIG. 6 during separation of the connection with respect to the second winding of a power transformer.
Figure 7B:
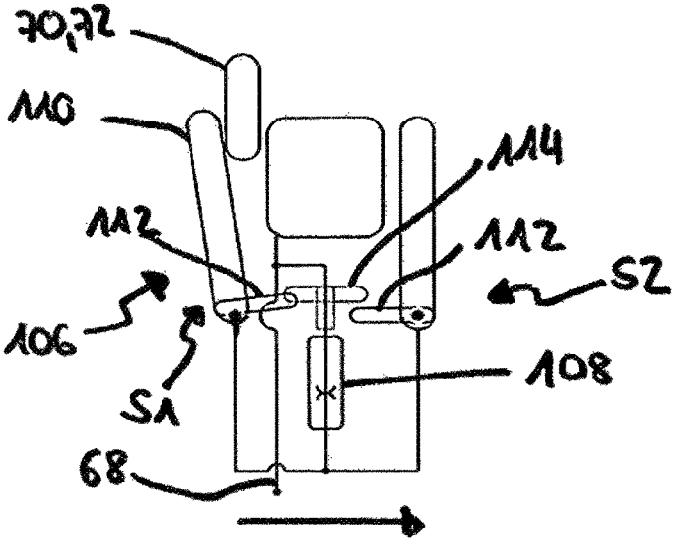
Figure 7C:
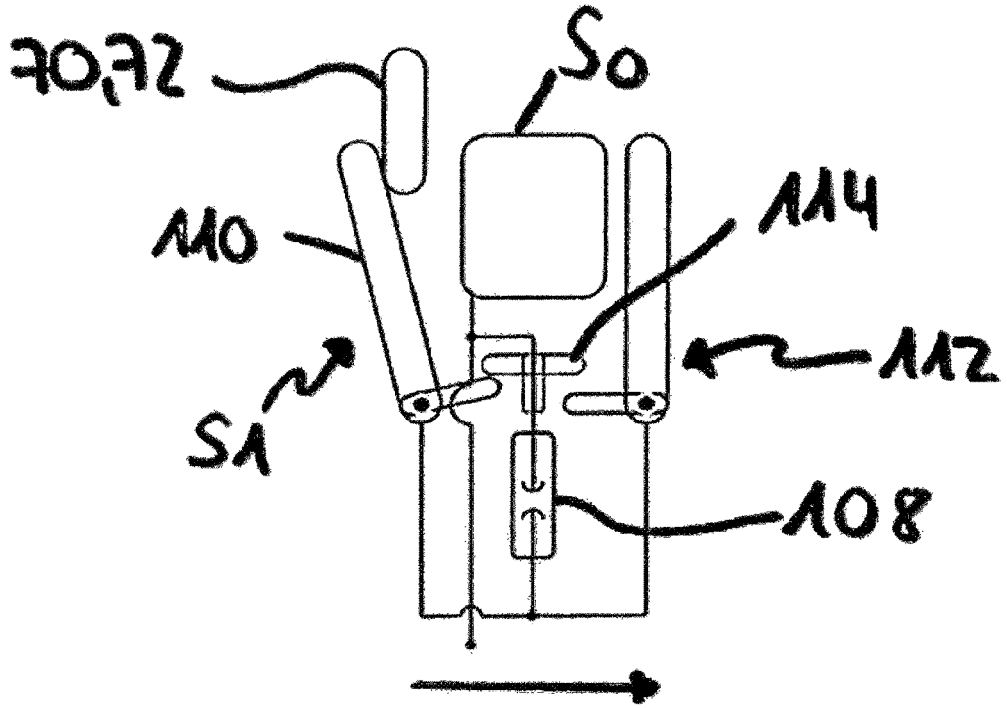

A switching sequence of that kind is now illustrated in FIGS. 7*a* to 7*d*. FIG. 7*a* shows the switching group 106 in connecting setting. The center switch element in that case directly connects the stationary switch contacts 70 or 72 with the tap 68 of the preselector 104. The two outer switch elements S1 and S2 are constructed in the form of a snap switch and have a rotatably mounted tongue 110 that is connected with a setting lever 112 to be secure against rotation relative thereto. The setting lever 112 interacts with an actuating element 114 of the vacuum switch, by which the vacuum switch can be opened or closed. In unactuated state of the actuating element 114, the vacuum switch 108 is closed. Here the current flows from the stationary switch contacts 70, 72 by S0 to the diverter 86.

Figure 7D:
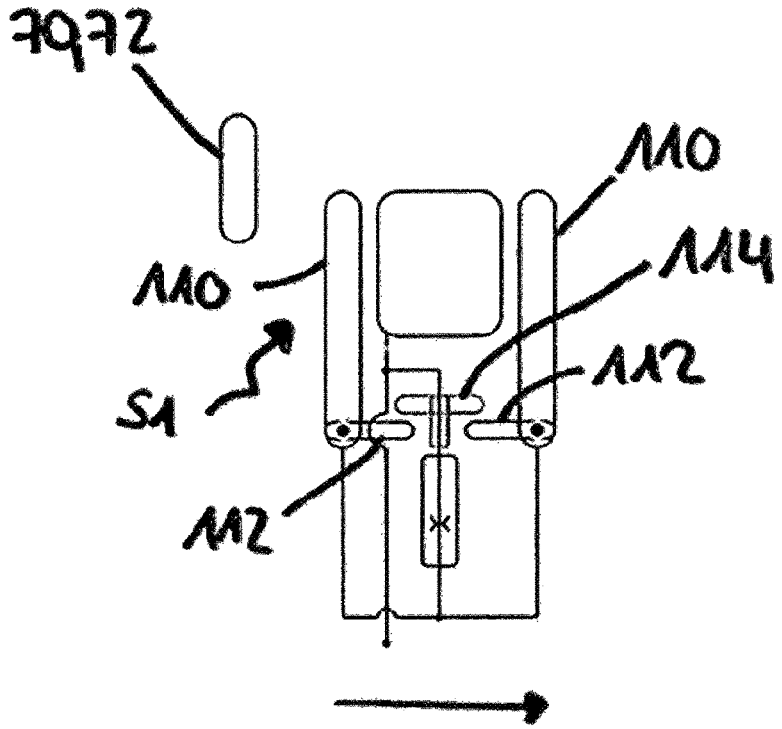

If the switch group 106 is moved in arrow direction (FIG. 7*b*), the stationary contact 70, 72 slides away from the center switch element S0 and initially contacts the tongue 110. In that case the tongue 110 of the first, outer switch element S1 deflects. The conductive connection between 70, 72 is now separated here and the current flows from the contact 70, 72 via the tongue 110 and the vacuum switch 108 to the tap 68. The setting lever 112 of this switch element S1 is thereby rotated upward, in which case it pushes the actuating element 114 of the vacuum switch 108 upward (FIG. 7*c*), as a result of which this is opened. Since no current now flows, 70, 72 can be detached from 110. This opening takes place through the vacuum switch 108 in the encapsulated space and thus in gas-free manner with respect to the oil medium. FIG. 7*d* shows the preselector 104 in completely opened setting between the stationary contacts 70, 72.

The invention is not restricted to the above-described embodiments, but can be varied within the scope of protection of the following claims.

With respect to the embodiment of FIG. 1 it is to be added that the polarity resistance 34 can, instead of the center tap 36, also be connectable by a further switch with a respective one of the two ends 30, 32 of the tap winding 14 or a respective polarity resistance 34 can be connectable at each end 30, 32 with the load tap point 19 by a respective vacuum switch.

The invention claimed is:

1. A switching arrangement with preselector for a power transformer having first and second windings, wherein the preselector is constructed so as to selectably connect the first winding with one of two end contacts of the second winding, and at least one first switch that is formed by a vacuum switch or a diode, or includes a vacuum switch or a diode circuit is connected between the preselector and the first winding.

2. The switching arrangement according to claim 1, wherein the first switch includes a load switch connected in parallel with the vacuum switch.

3. The switching arrangement according to claim 1, wherein the vacuum switch is a vacuum interrupter.

4. The switching arrangement according to claim 1, wherein the arrangement is constructed as a tap changer of a regulating transformer.

5. A regulating transformer with a switching arrangement according to claim 1.

6. A switching arrangement with preselector for a power transformer having first and second windings, wherein the preselector is constructed so as to selectably connect the first winding with one of two end contacts of the second winding, at least one first switch is connected between the preselector and the first winding, and a part of the first switch connected with the first winding is grounded by a varistor and/or a capacitor and/or a resistor.

7. A switching arrangement with preselector for a power transformer having first and second windings, wherein the preselector is constructed so as to selectably connect the first winding with one of two end contacts of the second winding, at least one first switch is connected between the preselector and the first winding, a polarity circuit connects a defined point of the second winding with the first winding during switching-over of the preselector, and a second switch is connectable or connected into the connection of the polarity circuit at the defined point with the first winding.

8. The switching arrangement according to claim 7, wherein at least one respective vacuum switch is arranged not only in the connection of the preselector with the first winding, but also in the connection of the polarity circuit with the first winding.

9. The switching arrangement according to claim 8, wherein the two vacuum switches are coupled.

10. The switching arrangement according to claim 8, wherein a mechanical switch is provided in the polarity circuit.

11. The switching arrangement according to claim 10, wherein the mechanical switch is coupled with the preselector.

12. The switching arrangement according to claim 7, wherein the polarity circuit comprises at least one polarity resistance.

13. The switching arrangement according to claim 7, wherein the defined point of the second winding is a center tap or selectably one of the two ends of the second winding.

* * * * *